US005605479A

United States Patent [19]

Krämer et al.

[11] Patent Number: 5,605,479

[45] Date of Patent: Feb. 25, 1997

[54] PANEL MOUNT CONNECTOR

[75] Inventors: Rudolf Krämer, Lautertal; Christian Schrettlinger, Bensheim; Werner Tille, Stockstadt, all of Germany

[73] Assignee: The Whitaker Corporation, Wilmington, Del.

[21] Appl. No.: 362,316

[22] Filed: Dec. 22, 1994

[30] Foreign Application Priority Data

Jan. 4, 1994 [GB] United Kingdom ..... 9400021

[51] Int. Cl.[6] ..... H01R 9/22

[52] U.S. Cl. ..... 439/709; 439/719

[58] Field of Search ..... 439/709, 710, 439/717, 719

[56] References Cited

U.S. PATENT DOCUMENTS 2,199,219 4/1940 Edwards et al. ..... 439/719 X 2,991,444 7/1961 Brereton ..... 439/719

5,326,285 7/1994 Maros ..... 439/717

5,415,567 5/1995 Fusselman et al. ..... 439/719 X

*Primary Examiner*—Khiem Nguyen

*Attorney, Agent, or Firm*—Driscoll A. Nina

[57] ABSTRACT

The connector comprises an insulative housing having a conductor connection section on one side of the panel and a mating section on the other side of the panel. The conductor connecting section comprises terminals arranged in two adjacent rows that are offset to provide a compact zig-zag arrangement. The terminals are separated by upstanding walls that form slots on the sides of the connector for receiving ring-tongue terminals that are clamped to the terminals by screws. To ensure a sufficient insulation between adjacent terminals, the walls must be made sufficiently long. In order to enable a compact juxtaposed assembly of connectors to a backpanel, the separating walls are slanted thereby forming a zig-zag outer profile of the connector sides such that sides of adjacent connectors interengage.

6 Claims, 3 Drawing Sheets

PANEL MOUNT CONNECTOR

BACKGROUND OF THE INVENTION

1. Field of the Invention

This invention relates to panel mounted connectors mountable in a compact juxtaposed manner in particular for interconnection with ring-tongue terminals.

2. Description of the Prior Art

It is common to find in the telecommunications industry, connectors having a large plurality of cables connected thereto, mounted to panels and matable with complementary connectors mounted on printed circuit boards. The panel may be a backpanel within a cabinet-like structure, the printed circuit boards being disposed perpendicularly thereto, whereby the connectors are blindly coupled by sliding the printed circuit boards into the cabinet until the connectors are mated.

Some backpanel connectors may comprise screw clamp terminals arranged in a pair of long rows whereby electrical connection is made to conductors by insertion thereof under a screw head which is then tightened to clamp the conductor against the terminal. Adjacent terminals must be separated by an insulative wall of sufficient length to ensure a sufficiently long electrical creep path therebetween. The latter however increases the width of the connector and therefore decreases the number of connectors that can be mounted to a given backpanel. There is therefore a need to provide a more compact panel mount connector having screw clamp terminals for interconnection to conductors such as a ring-tongue terminals.

SUMMARY OF THE INVENTION

It is an object of this invention to provide a connector having terminals for clamping down conductors, the connector being compactly mountable to a panel yet reliable.

The object of this invention has been achieved by providing a connector mountable to a panel, the connector comprising two rows of adjacent terminals offset such that they form a zig-zag arrangement whereby adjacent terminals of the same row are separated by oblique separating walls that ensure sufficient insulation therebetween and yet allow a plurality of connectors to be assembled close together in a juxtaposed manner.

DETAILED DESCRIPTION OF THE PREFERRED EMBODIMENT

Figure 1:
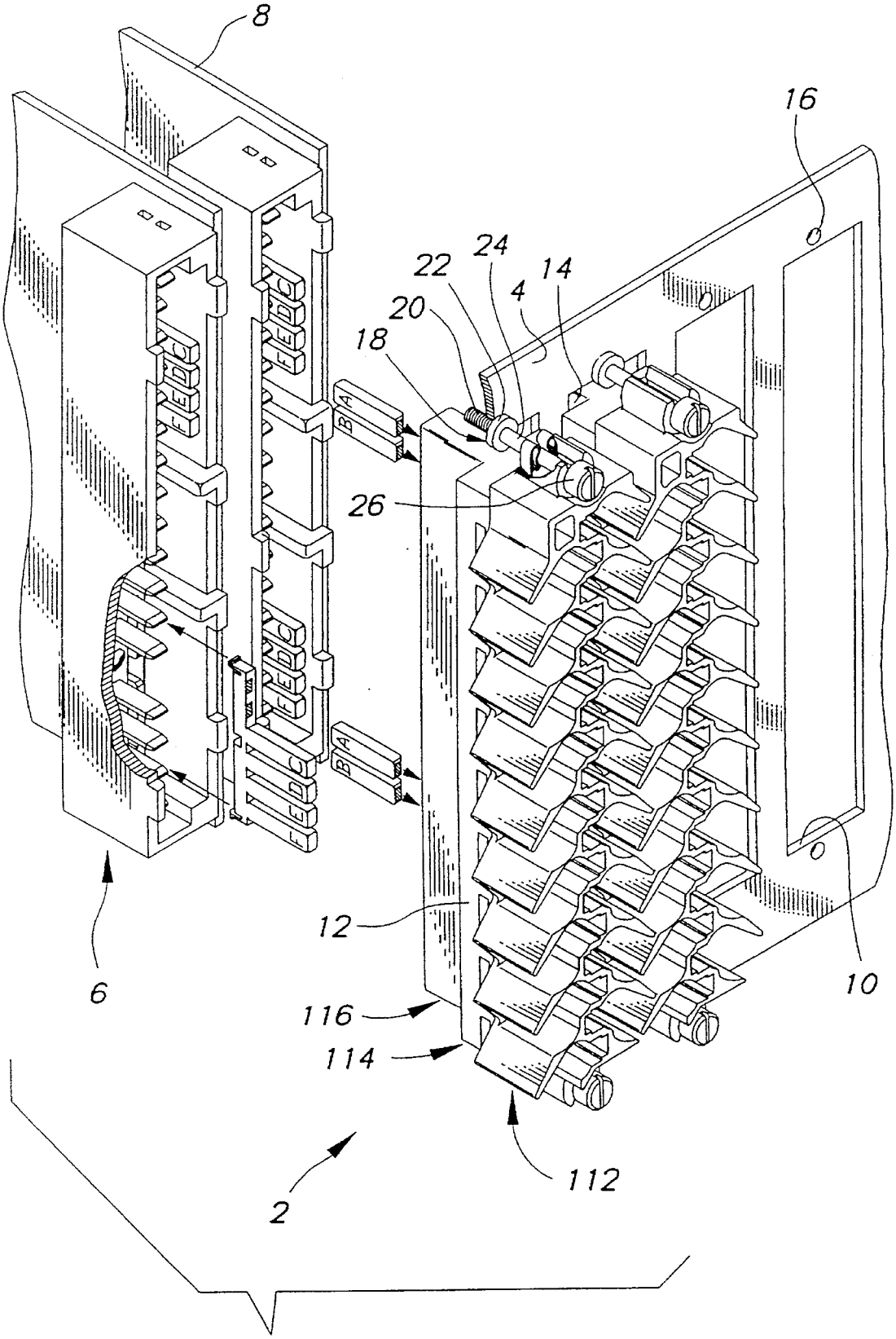
FIG. 1 is a partial isometric view of some panel mounted connectors about to be coupled to complementary connectors mounted on printed circuit boards.

With reference to FIG. 1, panel mount connectors 2 are shown mounted to a backpanel 4, and printed circuit board (PCB) mounted connectors 6 are mounted onto PCBs 8 and are about to be coupled together. The panel 4 comprises rectangular cutouts 10 through which are mounted the panel connectors 2 having a central body section 12 that is opposite but spaced with a certain tolerance gap 14 from the cutout 10 thereby allowing a certain amount of floating movement of the connector 2 with respect to the panel 4. Disposed just off either end of the longitudinal cutout 10, are threaded holes 16 receiving screws 18 for mounting the connectors to the panel.

Figure 2:
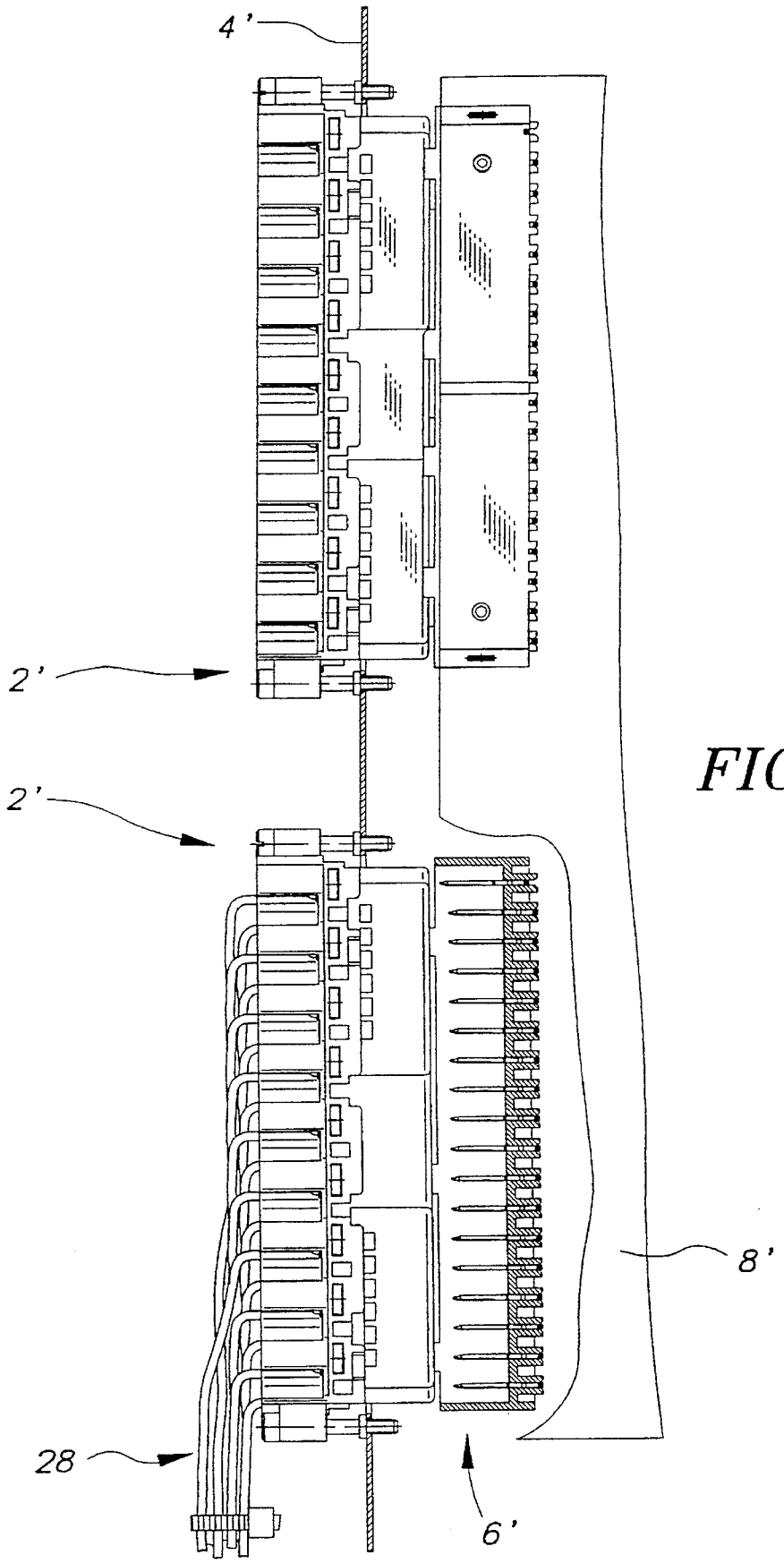
FIG. 2 is a partial cross-sectional view through a pair of connectors mounted on a printed circuit board and about to be coupled to a complementary pair of connectors mounted to a backpanel.

Referring now to FIG. 2, another disposition of connectors are shown, whereby pairs of connectors 2' are mounted to a backpanel 4' one above the other, and mate with a pair of connectors 6' mounted on a printed circuit board 8'. A plurality of conducting wires 28 are shown connected to one of the connectors 2'.

Referring to FIGS. 1 and 3 to 6, a pair of the panel connectors 2 are shown assembled to the panel 4 in a close juxtaposed manner, each connector comprising terminals 106 arranged in two rows 108, 110, the terminals of one row 108 offset overlapping with respect to terminals of the other row 110 such that the terminals 106 are disposed in a compact zig-zag arrangement. The terminals 106 are lodged within an insulative housing comprising a conductor receiving section 112 on one side of the panel 4, extending into a central section 114 projecting through the panel cutout 10, and extending therefrom a complementary connector mating section 116 projecting on the other side of the panel. The conductor receiving section 112 comprises a base wall 118 parallel to the panel 4, and upstanding therefrom away from the panel 4 are separating walls 120 between each adjacent terminal 106 of the same row 108, 110 of terminals, the walls 120 integrally attached to a central zig-zag wall 122 separating the two rows 108, 110.

The walls 120 extend obliquely away from the central zig-zag wall 122 such that the electrical creep path between adjacent terminals of the same row is longer than if the separating walls 120 were to extend orthogonally from the central partitioning wall 122. The upstanding walls 120, 122 are adjoined at their base by the base wall 118 integral therewith, that acts not only as a web to structurally support the walls 120, but also provides a platform for the conductors 28 to be clamped to conductor connection sections of the terminals 106. The base wall 118 joins outer side ends of the walls 120 in a zig-zag profiled manner whereby the zig-zag side contours 124, 126 on either side of the connector are opposed and offset similarly to the terminal rows 108, 110. The latter enables the connectors to be mounted in a close juxtaposed manner by interengagement of the zig-zag contour 126 of one connector to the opposing zig-zag side contour 124 of an adjacent connector whilst nevertheless maintaining a sufficiently long electrical creep path between adjacent terminals.

Additionally, the interengaging zig-zag profiles of the adjacent connectors, separates terminals of the adjacent connectors by the disposition of the outer ends of the oblique upstanding walls 120 that extend across a slot 128 formed by adjacent walls 120 of the adjacent connector. The latter provides added insulation protection between terminals of adjacent connectors and eliminates the need for the connector to have closed side walls joining ends of the upstanding walls 120.

Figure 6:
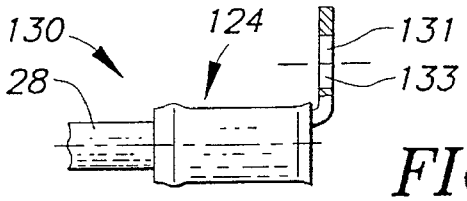
FIG. 6 is a partial cross-sectional view of a conductor crimped to a ring tongue terminal for connection to the connectors of FIG. 3.
Figure 3:
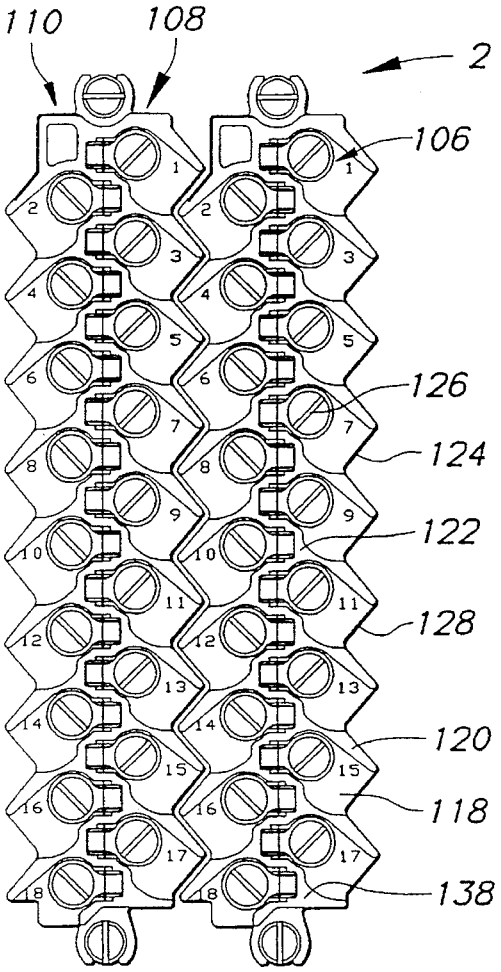
FIG. 3 is a top view of a pair of adjacent panel connectors of the embodiment of FIG. 1.
Figure 4:
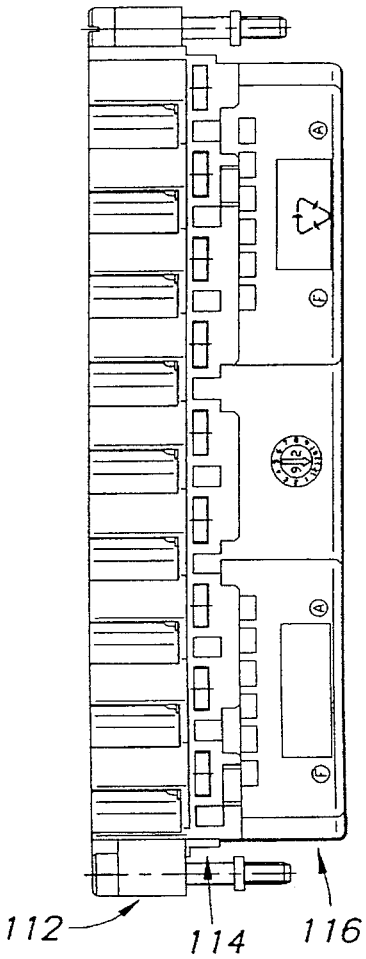
FIG. 4 is a side view of the connectors of FIG. 3.
Figure 5:
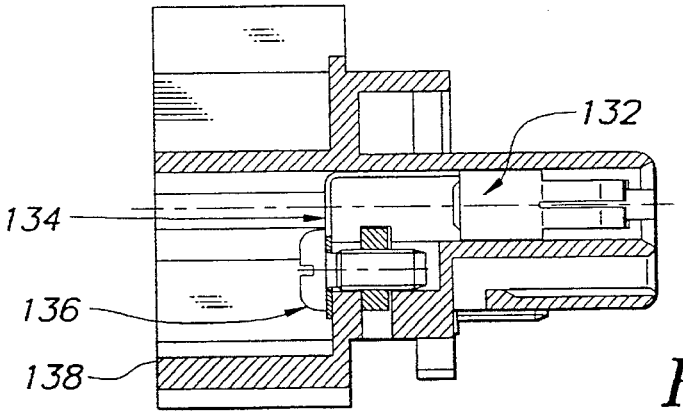
FIG. 5 is a cross-sectional view through the connector of FIG. 4.

As shown in FIG. 6, a conductor 130 for connection to the conducting wires 28, comprises a crimp barrel 129 surrounded by an insulative shell, and extending orthogonally therefrom a ring-tongue 131 having a screw receiving hole 133. The ring-tongue 131 may either be formed as a ring completely surrounding the screw receiving hole 133, or be provided with a slot joining the hole 133 to the periphery of the ring-tongue 131. In the former case, a screw for clamping the ring-tongue must be completely removed from the corresponding terminal for connection thereto, and in the latter case the screw simply has to be loosened and the slotted ring-tongue inserted beneath the screw head. The latter case therefore requires access laterally of the screw head for the terminal to be connected thereto. The preferred embodiment of this invention provides such access by way of slots 128 formed between adjacent separating walls 120 thereby allowing the conductor 130, crimped to the conducing wire 129 to be passed therethrough for connection to screw means 136 of the terminals 106.

The terminals 106 comprise a complementary mating section 132 received within the complementary mating section 116 of the connector 2, attached to a conductor connection portion 134 that extends onto the base wall 118 and to which the ring tongue portion 131 of the conductor 130 can be clamped by the screw means 136 accessible from a top face 138 of the connector for a screwdriver.

Mounting the conductors 130 to a ring tongue terminal 131 and clamping thereof to the connector terminal 106 via the screw 136, provides a flexible interconnection system for the user that can tailor the interconnections to his needs. The slots 128 are necessary to provide access for the ring tongue terminal 131 to be slipped underneath the head of the screw 136, but has the disadvantage of providing an additional path for the electricity to creep along to an adjacent terminal.

Depending on the differences in potential between the terminals, and certain environmental factors such as humidity, there is a danger of electricity creeping along the connector surface if the path between the terminals is short enough. As the conductors are connected to the terminals proximate the base wall 118, the electrical creep path directly between adjacent terminals would have to creep up the separating wall 120 to the top surface 138 and then down the wall 120 on the other side to the other terminal. Due to the height of the separating walls 120 this creep path can be maintained sufficiently long, however for the creep path along the base wall 118 and around the free ends of the separating walls 120 and back along the base wall to the adjacent terminal, the creep path length is dependant on how far outwards the separating walls 120 extend. In order to minimize volume requirements, the connectors should be positioned on the panel 4 in the most compact manner. The preferred embodiment of this invention enables the adjacent connectors to be positioned very close to each other and yet provide a long electrical creep path between adjacent terminals by inclining the separating walls 120 and providing the connectors with opposed offset zig-zag walls 124, 126 that interengage with those of the adjacent connectors. The separating walls 120 are also needed to guide the conductor when making the connection to the terminal 106, and also to ensure a sufficient air gap between terminals to prevent sparking therebetween. Additionally, one could imagine directly connecting the wires 28 to the terminal 106 without use of the ring-tongue terminal 131, whereby the guiding function and insulative separating of the walls 120 becomes particularly necessary.

Advantageously, the offset disposition of the rows of terminals, the inclined separating walls and the zig-zag side boundaries enable the connectors to be mounted in a compact juxtaposed manner to a panel yet allowing long electrical creep paths between adjacent terminals.

We claim:

1. A connector mountable to a panel, comprising an insulative housing and terminals mounted therein and arranged in two adjacent and parallel rows, each terminal of first row comprising a wire connection section accessible by a conductor through a slot from one side of the connector extending alongside the first row of terminals, and each terminal of a second row comprising a wire connection section accessible by a conductor through a slot from another side of the connector extending alongside the second row of terminals, the connector characterized in that the terminals of the first row are offset with respect to terminals of the second row such that terminals form a zig-zag arrangement, and each terminal is separated from an adjacent terminal of the same row by a wall of the housing, the wall extending obliquely from a position proximate the longitudinal centre line of the connector to the corresponding side thereof, whereby the adjacent separating walls define the slots.

2. The connector of claim 1 characterized in that the sides of the connector have zig-zag profiles such that a plurality of the connectors can be arranged in a juxtaposed manner with the zig-zag profile of one side of one of the connectors interengaging and substantially against the zig-zag profile of the other side of another adjacent connector.

3. The connector of claim 2 characterized in that the zig-zag profiles of the sides are formed by alternating portions of the separating walls and the slots, the portions of separating walls having substantially the same length as the width of the slots such that when two of the connectors are placed adjacent each other, the separating walls of one of the connectors cover substantially completely the slots of the adjacent second connector.

4. The connector of claim 1 characterized in that the terminal wire connection section is adapted for connection to a ring-tongue terminal.

5. The connector of claim 4 characterized in that the terminals of the first row are rotated 180°, about an axis orthogonal to the panel, with respect to terminals of the second row.

6. The connector of any of claims 1 to 5 characterized in that a zig-zag central wall, extending along the centre line of the connector, separates the two terminal rows and is integral with the separating walls.

* * * * *